US010871042B2

(12) United States Patent
Gonzalez et al.

(10) Patent No.: US 10,871,042 B2
(45) Date of Patent: Dec. 22, 2020

(54) DRILL PIPE RACK WITH REPLACEABLE BUSHINGS

(71) Applicant: Caterpillar Global Mining Equipment LLC, Denison, TX (US)

(72) Inventors: Fernando Gonzalez, Sherman, TX (US); Jason Spitler, Sherman, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 43 days.

(21) Appl. No.: 16/158,861

(22) Filed: Oct. 12, 2018

(65) Prior Publication Data

US 2020/0115970 A1 Apr. 16, 2020

(51) Int. Cl.
*E21B 19/14* (2006.01)

(52) U.S. Cl.
CPC ..... *E21B 19/146* (2013.01)

(58) Field of Classification Search
CPC ..... E21B 19/146
USPC ..... 175/85
See application file for complete search history.

(56) References Cited

U.S. PATENT DOCUMENTS 3,185,310 A * 5/1965 Klem ..... E21B 19/20 211/70.4
3,913,753 A 10/1975 Swartz et al.
4,445,579 A 5/1984 Bello
2016/0067857 A1* 3/2016 Moore ..... B25D 17/26 173/20
2017/0203629 A1* 7/2017 Womack ..... B60B 35/00

FOREIGN PATENT DOCUMENTS

GB 2 155 974 B 3/1987

* cited by examiner

*Primary Examiner* — Taras P Bemko
(74) *Attorney, Agent, or Firm* — Bookoff McAndrews

(57) ABSTRACT

A drill pipe rack for a mobile drilling machine is disclosed. The drill pipe rack may comprise a plurality of tubular receptacles extending from a base of the drill pipe rack to form a cup configuration. The drill pipe rack may further comprise a set of bushings, each bushing of the set of bushings may be received in a respective receptacle. Additionally, each bushing may have the same inner diameter, the inner diameter corresponding to an outer diameter of a drilling pipe segment of the mobile drilling machine.

17 Claims, 3 Drawing Sheets

DRILL PIPE RACK WITH REPLACEABLE BUSHINGS

TECHNICAL FIELD

The present disclosure relates generally to mobile drilling machines, and more particularly, drill pipe racks for such machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse and rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more. The mast of blasthole drills may also include a drill carousel which is structured and adapted to add pipe segments (e.g., drilling pipes, drill rods, drill extenders, etc.) to the drill string.

The drill carousel is typically used to selectively add the pipe segments to the drill string for drilling a hole having a desired depth. The drill carousel is intended to allow a drilling operation to progress into the drill hole by making readily available a continuous string of pipe segments as needed for advancing a drill bit into the drill hole. The drill carousel may include a drill pipe rack that stores pipe segments before being added to the drill string. The drill carousel may be rotated such that a selected pipe segment in the drill pipe rack is put into alignment with the drill string. The drill pipe rack typically includes a plurality of tubular receptacles, or cups, for receiving ends of the pipe segments. The tubular receptacles of current drill pipe racks are welded to a top surface of the drill pipe rack and are of one size and, thus current drill pipe racks allow for only a singular pipe diameter size to be stored. Further, current tubular receptacles may wear out due to continuous use or by drilling pipe segments hitting the tubular receptacles or otherwise placing the tubular receptacles out of alignment. As such, to replace worn tubular receptacles or to allow for drilling pipe segments of different diameters to be stored in the drill pipe rack, the tubular receptacles of current drill pipe racks require significant work, such as by cutting the tubular receptacles from the rack and welding on new, different-sized tubular receptacles.

U.S. Pat. No. 3,913,753, issued to Swartz et al. on Oct. 21, 1975 ("the '753 patent"), describes a drill carousel having a drill pipe rack for moving a section of drill pipe into alignment with a string of drill pipes. The drill pipe rack of the '753 patent includes a plurality of openings having a configuration complementary to flattened portions of the drill pipe sections. The '753 patent further discloses that the drill pipe rack includes a cylindrical flange that is welded or otherwise attached to the upper surface of the drill pipe rack about each of the openings. The flange is slightly larger than the diameter of the drill pipe sections and is adapted to receive and guide the lower end thereof. Thus, the '753 patent discloses a conventional drill pipe rack capable of receiving drill pipes of only a singular size. The '753 patent does not disclose that each opening of the drill pipe rack is adapted to receive bushings of different sizes to allow for pipes of various sizes to be stored in the drill pipe rack. The present disclosure may solve one or more of the problems set forth above and/or other problems in the art. The scope of the current disclosure, however, is defined by the attached claims, and not by the ability to solve any specific problem.

SUMMARY

In one aspect, a drill pipe rack for a mobile drilling machine is disclosed. The drill pipe rack may comprise: a plurality of tubular receptacles extending from a base of the drill pipe rack to form a cup configuration; and a set of bushings, each bushing of the set of bushings: being received in a respective receptacle, and having the same inner diameter, the inner diameter corresponding to an outer diameter of a drilling pipe segment of the mobile drilling machine.

In another aspect, a bushing configured to be inserted into a receptacle of a drill pipe rack of a mobile drilling machine is disclosed. The bushing may comprise an outer surface that defines an outer diameter of the bushing; and an inner surface that defines an inner diameter of the bushing, the inner surface corresponding to a standard diameter of a drilling pipe segment for use in the mobile drilling machine.

In yet another aspect, a drill pipe rack for a mobile drilling machine is disclosed. The drill pipe rack may comprise: a plurality of tubular receptacles extending from a base of the pipe rack to form a cup configuration; a first set of bushings, each bushing of the first set of bushings: being received in a respective receptacle, and having the same inner diameter, the inner diameter corresponding to an outer diameter of a drilling pipe segment of the mobile drilling machine; and a second set of bushings configured to replace the first set of bushings, each bushing of the second set of bushings: being received in a respective receptacle, and having the same inner diameter, but a different inner diameter than the first set of bushings, the inner diameter of the second set of bushings corresponding to a different outer diameter of a drilling pipe segment of the mobile drilling machine.

BRIEF DESCRIPTION OF THE DRAWINGS

The accompanying drawings, which are incorporated in and constitute a part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
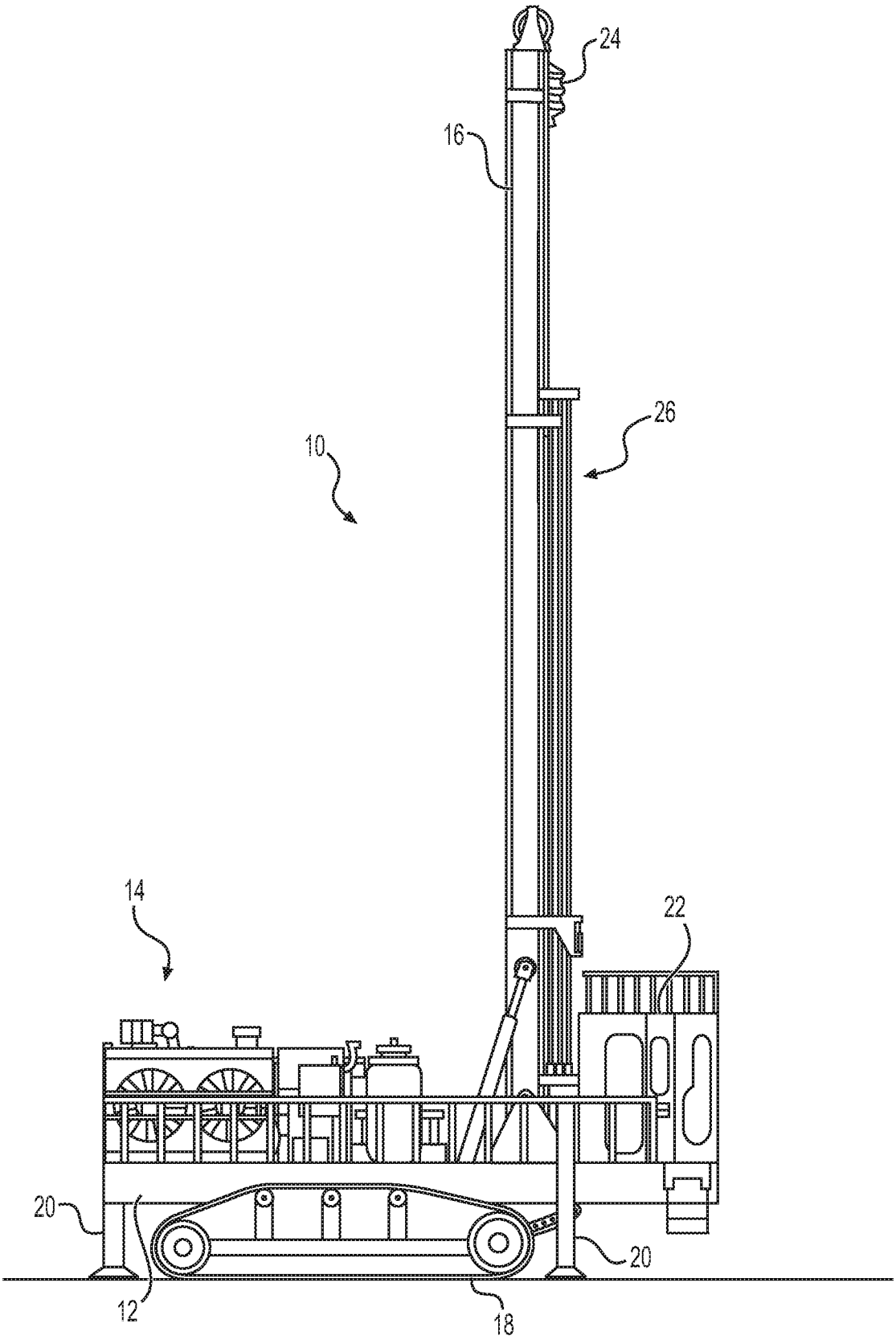
FIG. 1 illustrates a side view of an exemplary mobile drilling machine having a drill carousel, according to aspects of the disclosure.

FIG. 1 illustrates a side view of a mobile drilling machine 10, such as a blasthole drilling machine, having a drill carousel 26, according to aspects of the disclosure. As shown in FIG. 1, mobile drilling machine 10 may include a frame 12, machinery 14, and a drilling mast 16. Frame 12 may be supported on a ground surface by a transport mechanism, such as crawler tracks 18. Crawler tracks 18 may allow mobile drilling machine 10 to maneuver about the ground surface to a desired location for a drilling operation. Frame 12 may further include one or more jacks 20 for supporting and leveling mobile drilling machine 10 on the ground surface during the drilling operation. Frame 12 may support the machinery 14, which may include engines, motors, batteries, pumps, air compressors, and/or any other equipment necessary to power and operate mobile drilling machine 10. Frame 12 may further support an operator cab 22, from which an operator may maneuver and control mobile drilling machine 10.

Figure 2:
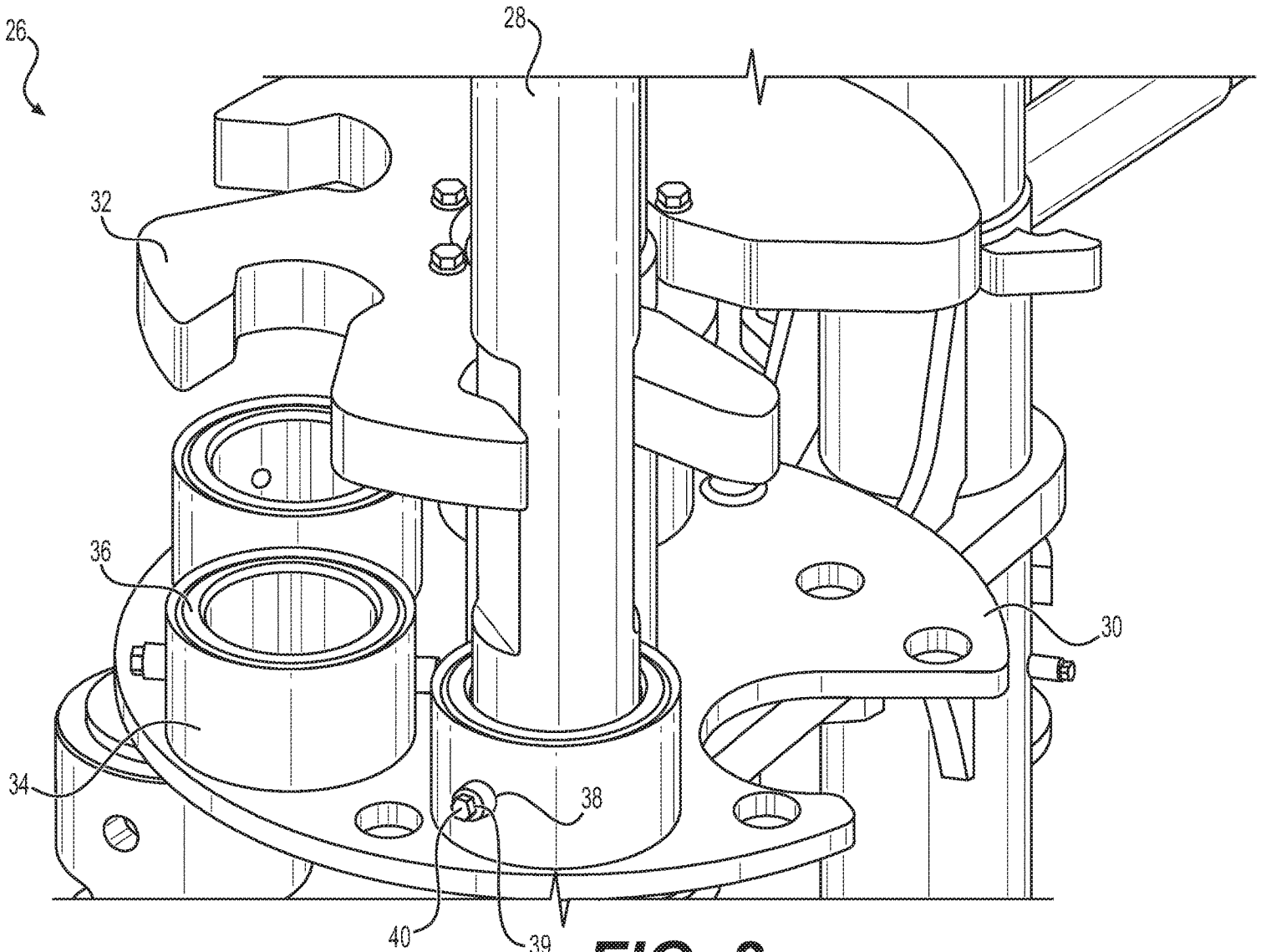
FIG. 2 illustrates an enlarged perspective view of a bottom portion of a drill carousel of the mobile drilling machine of FIG. 1.

As further shown in FIG. 1, drilling mast 16 may include a mast frame which may support a movable drill motor assembly 24, such as a rotary head. The drill motor assembly 24 may couple to, and rotate, a drill string (not shown) of drilling pipe segments 28 (as shown in FIG. 2) on which a drill bit (not shown) is mounted for drilling into the ground surface. Drilling mast 16 may further include a drill carousel 26, shown schematically on the drilling mast 18 in FIG. 1.

FIG. 2 illustrates an enlarged perspective view of a bottom portion of the drill carousel 26 of the mobile drilling machine 10. The drill carousel 26 may be structured and adapted to support one or more drill components, such as drilling pipe segments 28. As shown in FIG. 2, the drill carousel 26 may include a drill pipe rack 30 located at a bottom portion of the drill carousel 26 and a breaker plate 32 spaced vertically above the drill pipe rack 30. The drill pipe rack 30 may be configured to support a bottom end of the drilling pipe segments 28, as further described below. The breaker plate 32 may be configured to prevent rotation of a select drilling pipe segment 28 when the select drilling pipe segment 28 is being added to, or removed from, the drill string. The breaker plate 32 may be any conventional breaker plate suitable to prevent rotation of the select drilling pipe segment 28 when engaged with the select drilling pipe segment 28. The drill carousel 26 may further include a retainer plate (not shown) located at a top portion of the drill carousel 26. The retainer plate may be configured to support top ends of the drilling pipe segments 28. The retainer plate may be any conventional retainer plate suitable to support top ends of the drilling pipe segments 28.

The drill pipe rack 30 may include a plurality of tubular receptacles 34 extending from a base of the drill pipe rack 30 to form a cup configuration. Each of the plurality of tubular receptacles 34 may be configured to hold drill components, such as the drilling pipe segments 28. For clarity, only one tubular receptacle 34 is shown to be holding a drilling pipe segment 28 in FIG. 2. However, any, or all, of the plurality of tubular receptacles 34 may hold a drilling pipe segment 28. The plurality of tubular receptacles 34 may each have a generally cylindrical shape and may each be welded or otherwise fixedly attached to a top surface of the drill pipe rack 30. In the exemplary embodiment, the plurality of tubular receptacles 34 of drill pipe rack 30 may include four tubular receptacles 34. However, the plurality of tubular receptacles 34 may include any number of tubular receptacles 34 as necessary. The plurality of tubular receptacles 34 may each be configured to receive a bushing 36, as further described below. Each of the plurality of tubular receptacles 34 may be the same size and shape. Each of the plurality of tubular receptacles 34 may further include one or more bosses 38 having a hole 39 extending therethrough, and extending through a wall of the tubular receptacle 34. The bosses 38 may be configured to receive a removable fastener 40. Removable fastener 40 may be any suitable removable fastener, such as a threaded bolt or the like. Removable fastener 40 may extend through the boss 38, through the wall of the receptacle 34, and into the bushing 36 to prevent the bushing 36 from rotating when the bushing 36 has been inserted into a respective receptacle 34. It is understood that any one or more of the boss 38, receptacle 34, and bushing 36 could include threads or other features for securing removable fastener 40.

Figure 3:
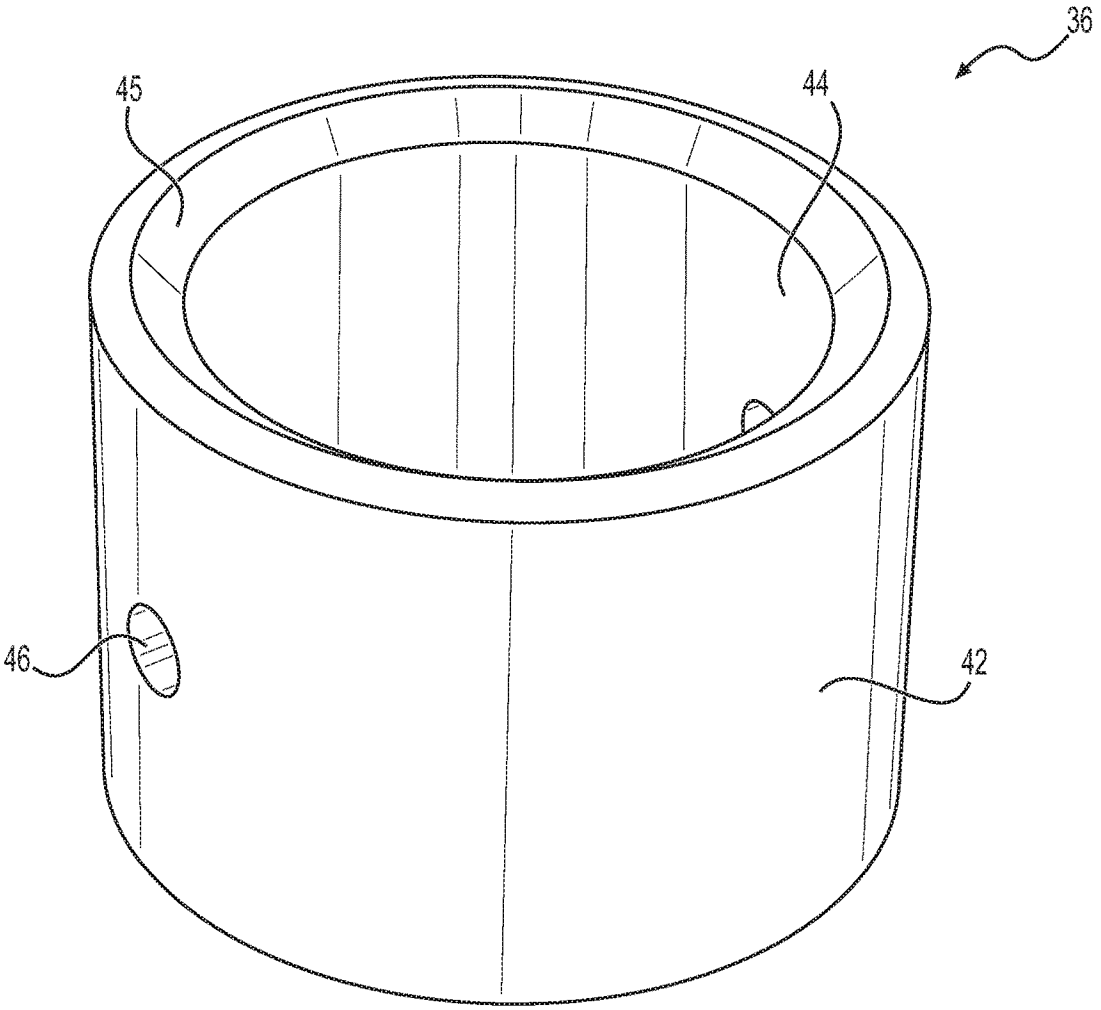
FIG. 3 illustrates a perspective view of an exemplary replaceable bushing isolated from the drill carousel of FIG. 2.

FIG. 3 illustrates a perspective view of an exemplary bushing 36 isolated from the drill carousel 26 of the mobile drilling machine 10. As shown in FIG. 3, bushing 36 may have a generally tubular, cylindrical shape, corresponding to the generally cylindrical shape of the plurality of receptacles 34. Bushing 36 may be made of steel, alloys, non-ferrous metals, polymers, or the like. Bushing 36 may have two open ends and may have an outer surface 42 and an inner surface 44. The outer surface 42 may define an outer diameter of the bushing 36 and the inner surface 44 may define an inner diameter of the bushing 36. The outer diameter of bushing 36 may correspond to an inner diameter of each of the plurality of tubular receptacles 34, such that a bushing 36 may fit into each of the plurality of tubular receptacles 34 with minimal clearance (e.g., between 0 millimeters and approximately 4 millimeters). Additionally, bushing 36 may include a height generally the same as a height of each of the plurality of tubular receptacles 34 when the bushing 36 is located in a respective tubular receptacle 34.

Bushing 36 may be configured to receive a bottom end of a drilling pipe segment 28. As such, the diameter of the inner surface 44 of bushing 36 may correspond to a diameter of the drilling pipe segments 28, such that the drilling pipe segment 28 may fit into each of the plurality of bushings 36 with minimal clearance (e.g., between 0 millimeters and approximately 4 millimeters). For example, the inner surface 44 of bushing 36 may correspond to a standard diameter of a drilling pipe segment 28. As used herein, the standard diameter of drilling pipe segments 28 may be, for example, 4.0 inches, 4.5 inches, 5.0 inches, 5.5 inches, 6.0 inches, 6.5 inches, 7.0 inches, 7.625 inches, 8.0 inches, 8.625 inches, 9.25 inches, 10.75 inches, 12.75 inches, or 13.375 inches. As shown in FIG. 3, the inner surface 44 of bushing 36 may include a taper 45 at one of the open ends to aid in guiding the bottom end of the drilling pipe segments 28 into bushing 36. As noted above, bushing 36 may further include one or more holes 46. The one or more holes 46 may be located at a mid-section height of bushing 36 and may extend from the outer surface 42 through bushing 36 to the inner surface 44. The one or more holes 46 of bushing 36 may be located to align with the one or more holes 39 of each of the plurality of tubular receptacles 34. As such, one or more removable fasteners 40 may be inserted into the boss 38 of a respective receptacle 34, as well as into the one or more holes 46 of the respective bushing 36. Thus, bushing 36 may be prevented from rotating when inserted into a respective receptacle 34. In the exemplary embodiment, bushing 36 may include two holes 46 located opposite each other, the two holes 46 located to align with two corresponding bosses 38 of each of the plurality of tubular receptacles 34. However, bushing 36 may include any number of holes 46 as necessary to align with corresponding bosses 38 of the tubular receptacles 34.

The exemplary bushing 36 may be part of a set of bushings 36, with each bushing 36 of a set having the same size and shape. In the exemplary embodiment, each set of bushings 36 may include four identical bushings 36, corresponding to the four tubular receptacles 34 of the drill pipe rack 30. However, each set of bushings 36 may include any number of bushings 36, as necessary, corresponding to the number of tubular receptacles 34 on drill pipe rack 30. While each bushing 36 of a set may be identical, each set would include bushings having a different inner diameter than another set, so that each bushing set would correspond to drilling pipe segments 28 of a different diameter. For example, at least eight different bushing sets may be provided, with each bushing set having different inner diameter sizes, such that a first bushing set includes a first inner diameter size, a second bushing set includes a second inner diameter size different than the first diameter size, a third bushing set includes a third inner diameter size different than the first and second diameter sizes, and so forth. Each bushing 36 of a bushing set may be selectively secured in a respective tubular receptacle 34 so as to allow for replacement of the bushings 36. Therefore, the plurality of tubular receptacles 34 of the drill pipe rack 30 may receive a first set of bushings 36 having a first inner diameter for receiving drilling pipe segments 28 of a first diameter. The first set of bushings 36 having a first inner diameter may be replaced with a second set of bushings 36 having a second inner diameter for receiving drilling pipe segments 28 of a second diameter, and so forth. Additionally, each bushing 36 may have a height generally the same as a height of each of the plurality of tubular receptacles 34 when the bushing 36 is located in a respective tubular receptacle 34.

Referring to FIGS. 2 and 3, a method is provided for reconfiguring a drill pipe rack 30 of a mobile drill machine 10 to receive drilling pipe segments 28 of different pipe diameter sizes. At a first step, the method may include inserting a first set of bushings 36 having a first inner diameter into respective tubular receptacles 34. Each bushing 36 of the first set of bushings 36 may include one or more holes 46 that may align with respective one or more bosses 38 and holes 39 of each tubular receptacle 34 when each bushing 36 is inserted into a respective tubular receptacle 34. The first set of bushings 36 may be secured and prevented from rotating in the respective tubular receptacles 34 by inserting a removable fastener 40 into the holes 39 of the one or more bosses 38 of each tubular receptacle 34 and respective one or more holes 46 of each bushing 36. The first set of bushings 36 having a first inner diameter may selectively receive drilling pipe segments 28 having a first standard pipe diameter size corresponding to the first inner diameter of the first set of bushings 36. At a second step, the method may include removing the first set of bushings 36 from the respective tubular receptacles 34. The removable fasteners 40 may be removed prior to removing the first set of bushings 36.

At a third step, the method may include inserting a second set of bushings 36 having a second inner diameter into respective tubular receptacles 34. The second inner diameter of the second set of bushings 36 may be different than the first inner diameter of the first set of bushings 36. Each bushing 36 of the second set of bushings 36 may include one or more holes 46 that may align with respective one or more bosses 38 and holes 39 of each tubular receptacle 34 when each bushing 36 is inserted into a respective tubular receptacle 34. The second set of bushings 36 may be secured and prevented from rotating in the respective tubular receptacles 34 by inserting a removable fastener 40 into the holes of the one or more bosses 38 of each tubular receptacle 34 and respective one or more holes 46 of each bushing 36. The second set of bushings 36 having a second inner diameter may selectively receive drilling pipe segments 28 having a second standard pipe diameter size corresponding to the second inner diameter of the second set of bushings 36. The second standard pipe diameter size may be different than the first standard pipe diameter size. Thus, drill pipe rack 30 may be reconfigured to receive drilling pipe segments 28 having different diameters.

INDUSTRIAL APPLICABILITY

The disclosed aspects of the drill carousel 26 may be used by any mobile drilling machine 10 having a drill carousel 26 with a drill pipe rack 30 for storing drilling pipe segments 28. Referring to FIG. 2, drill carousel 26 may be used to selectively add drilling pipe segments 28 to the drill string. Drill carousel 26 may be configured to swing or pivotally move between an add/remove position (i.e., in axial alignment with the drill string) for adding or removing drilling pipe segments 28 to or from the drill string, and a stowed position (i.e., adjacent the drill string) during the drilling operation. As described above, the plurality of tubular receptacles 34 may each receive a bushing 36. A removable fastener 40 may be inserted into one or more bosses 38 of each of the plurality of tubular receptacles 34 and into corresponding one or more holes 46 of each bushing 36. Thus, the bushings 36 may be secured in a respective receptacle 34 and rotation of each bushing 36 may be prevented. One or more of the bushings 36 may be empty at any time for receiving drilling pipe segments 28 that are removed from the drill string.

If the operator of the mobile drilling machine 10 desires drilling pipe segments 28 of a different diameter, the set of bushings 36 may be removed from the plurality of tubular receptacles 34 and replaced. Likewise, if any of the bushings 36 have worn out, the respective worn out bushing 36 may be removed and replaced. When removing a bushing 36 or a set of the bushings 36 from the plurality of tubular receptacles 34, the removable fasteners 40 may be removed and the bushings 36 may then be removed from the receptacles 34. Replaceable bushings 36 being new or having a different inner diameter size may then be placed into the plurality of receptacles 34. The removable fasteners 40 may be re-inserted into the one or more bosses 38 of the plurality of tubular receptacles 34 and the corresponding one or more holes 46 of each bushing 36. Therefore, the drill pipe rack 30 of the present disclosure is capable of receiving bushings 36 having different inner diameters for receiving drilling pipe segments 28 of various diameters and/or lengths.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A drill pipe rack for a mobile drilling machine, comprising:

a plurality of tubular receptacles fixedly attached to, and extending axially from, a top surface of a base of the drill pipe rack to form a cup configuration, wherein each of the plurality of tubular receptacles includes one or more holes, and the drill pipe rack further includes a removable fastener extending into one of the holes; and a set of tubular bushings, each tubular bushing of the set of bushings:

being received in a respective receptacle, and having the same inner diameter, the inner diameter corresponding to an outer diameter of a drilling pipe segment of the mobile drilling machine.

2. The drill pipe rack of claim 1, wherein each bushing is a tubular bushing having two open ends.

3. The drill pipe rack of claim 2, wherein each tubular bushing includes an inner surface taper at one of the two open ends.

4. The drill pipe rack of claim 1, wherein each bushing of the set of bushings includes the same outer diameter.

5. The drill pipe rack of claim 4, wherein each bushing of the set of bushings includes an outer diameter corresponding to an inner diameter of the tubular receptacles.

6. The drill pipe rack of claim 1, wherein each bushing of the set of bushings includes a height generally the same as the tubular receptacles when located in the tubular receptacles.

7. The drill pipe rack of claim 1, wherein each bushing of the set of bushings is selectively secured in the tubular receptacles so as to allow for replacement of the bushings.

8. The drill pipe rack of claim 1, wherein each bushing includes one or more holes aligned with the one or more holes of a respective receptacle, and the removable fastener extends into aligned holes of the receptacle of the bushing.

9. The drill pipe rack of claim 1, wherein the set of bushings are a first set of bushings, and the drill pipe rack includes a second set of bushings, the second set of bushings have the same outer diameter as the first set of bushings, but a different inner diameter than the first set of bushings.

10. A tubular bushing inserted into a tubular receptacle fixedly attached to, and extending axially from, a top surface of a base of a drill pipe rack of a mobile drilling machine, the tubular bushing comprising:

an outer surface that defines an outer diameter of the tubular bushing, wherein the bushing includes a tubular shape having two open ends;

an inner surface that defines an inner diameter of the tubular bushing, the inner surface corresponding to a standard diameter of a drilling pipe segment for use in the mobile drilling machine; and one or more holes extending through the outer surface of the bushing.

11. The bushing of claim 10, wherein the one or more holes are located in a mid-section of the bushing.

12. The bushing of claim 11, wherein the inner surface of the bushing includes a taper at one of the two open ends.

13. The bushing of claim 12, wherein the bushing is made of metal.

14. The bushing of claim 13, wherein the bushing includes two holes, each hole extending from an outer surface of the bushing through an inner surface of the bushing, wherein the two holes are located opposite each other.

15. A drill pipe rack for a mobile drilling machine, comprising:

a plurality of tubular receptacles fixedly attached to, and extending axially from, a top surface of a base of the pipe rack to form a cup configuration;

a first set of tubular bushings, each tubular bushing of the first set of tubular bushings:

being received in a respective receptacle, and having the same inner diameter, the inner diameter corresponding to an outer diameter of a drilling pipe segment of the mobile drilling machine; and a second set of tubular bushings configured to replace the first set of tubular bushings, each tubular bushing of the second set of tubular bushings:

being received in a respective receptacle, and having the same inner diameter, but a different inner diameter than the first set of tubular bushings, the inner diameter of the second set of tubular bushings corresponding to a different outer diameter of a drilling pipe segment of the mobile drilling machine.

16. The drill pipe rack of claim 15, wherein each of the plurality of receptacles includes one or more holes extending through a wall of the receptacle, and each bushing includes one or more holes for alignment with the one or more holes of the receptacles, and the drill pipe rack further including a removable fastener extending into aligned holes of the receptacle and bushing.

17. The drill pipe rack of claim 16, wherein each bushing includes an outer diameter, the outer diameter being the same for the first set of bushings and the second set of bushings.

* * * * *